US006526619B1

(12) United States Patent
Cassels, Jr.

(10) Patent No.: US 6,526,619 B1
(45) Date of Patent: Mar. 4, 2003

(54) GUTTER CLEANING SYSTEM

(76) Inventor: Donald M. Cassels, Jr., 3901 Kristin Pl., Valrico, FL (US) 33594

( * ) Notice: Subject to any disclaimer, the term of this patent is extended or adjusted under 35 U.S.C. 154(b) by 174 days.

(21) Appl. No.: 09/663,066

(22) Filed: Sep. 15, 2000

(51) Int. Cl.[7] ..... E04D 13/076

(52) U.S. Cl. ..... 15/236.04; 15/144.1; 15/144.4; 15/235.8; 172/372; 172/380; 294/19.1; 294/53.5

(58) Field of Search ..... 15/144.1, 144.3, 15/144.4, 236.01, 236.04, 235.8; 294/19.1, 53.5, 57; 172/371, 372, 380

(56) References Cited

U.S. PATENT DOCUMENTS

| | | | | | |
|---|---|---|---|---|---|
| 1,109,469 | A | * | 9/1914 | Sandberg | 172/372 |
| 1,253,284 | A | * | 1/1918 | Schoener | 172/372 |
| 1,342,392 | A | * | 6/1920 | Oleen | 172/372 X |
| 1,376,995 | A | * | 5/1921 | Balsley | 172/371 X |
| 1,411,195 | A | * | 3/1922 | Shingler | 294/57 |
| 1,500,132 | A | * | 7/1924 | Hummelgard | 172/372 X |
| 3,773,375 | A | * | 11/1973 | Nehls | 15/144.1 X |
| 4,502,806 | A | * | 3/1985 | Albertson | 15/236.04 X |
| 4,726,090 | A | * | 2/1988 | Kilpatrick | 15/236.04 |
| 4,848,818 | A | * | 7/1989 | Smith | 294/19.1 |
| 4,904,011 | A | * | 2/1990 | Hawk | 294/57 X |
| 5,288,118 | A | * | 2/1994 | Hartselle, III | 294/19.1 |
| 5,577,786 | A | * | 11/1996 | Laine | 294/53.5 X |
| 5,810,408 | A | * | 9/1998 | Armstrong | 294/57 |
| 6,199,245 | B1 | * | 3/2001 | Blessing | 294/57 X |

FOREIGN PATENT DOCUMENTS

| | | | | |
|---|---|---|---|---|
| DE | 3716068 | * | 11/1988 | 294/57 |
| FR | 2522575 | * | 9/1983 | 294/53.5 |

* cited by examiner

*Primary Examiner*—Mark Spisich

(57) ABSTRACT

A gutter cleaning system has a shovel with a working surface and a connecting component. The connecting component is a rigid member. A handle has inboard and outboard components and a locking mechanism to vary the length of the handle. An adjustable holder has an inboard component coupled to the handle, an outboard component coupled to the shovel, and a locking bolt with a wingnut to vary the angle between the shovel and the handle.

2 Claims, 3 Drawing Sheets

10
14
22
2
2
24
50

26
28
32
56
54
58
34
18
14

GUTTER CLEANING SYSTEM

BACKGROUND OF THE INVENTION

1. Field of the Invention

The present invention relates to a gutter cleaning system and more particularly pertains to conveniently removing debris from gutters.

2. Description of the Prior Art

The use of house maintenance devices and apparatuses of known design and configuration is known in the prior art. More specifically, house maintenance devices and apparatuses of known design and configuration previously devised and utilized for the purpose of simplifying house maintenance through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,855,402 to Maraschiello, issued Jan. 5, 1999 discloses a rain gutter cleaning tool wherein the tool is supported and carried on an elongated pole with a fixed handle at one end, an intermediate actuating handle and operating gripper jaw mechanism on the other end. U.S. Pat. No. 5,988,715 to Mason, issued Nov. 23, 1999 discloses an apparatus for cleaning drain gutters. It includes a scoop member, a pole of telescopically adjustable length, and an attachment member of inverted U-shaped configuration that extends in joinder between the scoop member and the pole. U.S. Pat. No. 6,017,070 to Poppa, issued Jan. 25, 2000, discloses a cleaning tool particularly adapted for cleaning gutters. The tool has members which are movable relative to each other by a mechanism that is manipulated by the user on a pole that allows the members to be placed at an elevated site and then closed upon the material to be removed, then lifted and the material released. U.S. Pat. No. 4,848,818 to Smith, issued Jul. 18, 1989, discloses a gutter cleaning tool, with a multi-positional and a self locking joint, that can be remotely operated by hand from an oblique angle. U.S. Pat. No. 4,835,799, issued to Beelart, Jr., Issued Jun. 6, 1989 discloses an apparatus for manipulating the hinged member. U.S. Pat. No. 4,726,090, issued to Kilpatrick on Feb. 23, 1988, discloses a gutter cleaning device for use by a person standing on the roof of the house or building. Lastly, U.S. Pat. No. 4,542,553, issued to Cary on Sep. 24, 1985 relates to a device for removing debris from gutters. The tool comprises a singular rod-like member to which is attached a plate adjacent one end and a handle adjacent the other, an which is so configured that the plate can be scraped along an eave trough by a user and which can safely be used by a user positioned on a ladder.

While these devices fulfill their respective, particular objectives and requirements, the aforementioned patents do not describe a gutter cleaning system that allows conveniently removing debris from gutters.

In this respect, the a gutter cleaning system according to the present invention substantially departs from the conventional concepts and designs of the prior art, and in doing so provides an apparatus primarily developed for the purpose of conveniently removing debris from gutters.

Therefore, it can be appreciated that there exists a continuing need for a new and improved a gutter cleaning system which can be used for conveniently removing debris from gutters. In this regard, the present invention substantially fulfills this need.

SUMMARY OF THE INVENTION

In view of the foregoing disadvantages inherent in the known types of house maintenance devices and apparatuses of known design and configuration now present in the prior art, the present invention provides an improved a gutter cleaning system. As such, the general purpose of the present invention, which will be described subsequently in greater detail, is to provide a new and improved a gutter cleaning system and method which has all the advantages of the prior art and none of the disadvantages.

To attain this, the present invention essentially comprises a gutter cleaning system for safely and conveniently removing debris from gutters comprising the following components, in combination. The shovel is in a flat, rectangular configuration. The shovel is comprised of a rigid material, preferably metal, and has a thickness of between about $^{10}/_{1000}$ths to $^{30}/_{1000}$ths of an inch, giving it strength and rigidity to sufficiently provide a rigid, durable working surface. The shovel size is between about 5 and 6 inches in length on the longitudinal axis, and between about 2 to 3 inches in width on the transverse axis, also known as the lateral axis, having a ratio of length to width being between about 2.0 to 2.5. The shovel ends with an square edge on the outboard end and in a V-like shape, pointed in the long axis, at the inboard end. There is a connecting component comprising a rigid, preferably metal, shaft, having the diameter of between about ¼ inch to ¾ inch, in a "Z" shaped configuration. The two ends of the "Z" have between about 10 to 30 degrees of angle off the longitudinal axis of the shovel. The central portion is continuous with the two ends, the outboard end being attached and blended into the shovel surface, by a weld to the midpoint of the inboard end of the shovel. The weld is located at the midpoint of the inboard end of the shovel. The inboard end of the connecting component is in the form of a rounded shaft. The next component is a handle which has an inboard and outboard component. The outboard component comprises a straight, tube-like shaft of lightweight material, between about ½ inch to 1–½ inches in diameter, having a wall thickness sufficient to provide rigidity. The outboard component has an open outboard end, the opening being sized to tightly accommodate the inboard shaft of the handle thread, that comprises a shaft of plastic, between about 2 and 4 inches long, having an inboard and outboard end. The inboard end is defined as that part of the handle thread, from the mid-length point of the handle thread, to the inboard end, having a diameter of between about ¾ inch and 1–½ inches, lying in the longitudinal plane with a flat inboard end. The outboard portion of the handle thread runs from the mid-length point of the handle thread shaft, along the longitudinal axis to the outboard end of the handle thread. The outboard portion is threaded to mate with the threads of the inboard end of the handle connector. The outboard handle runs inboardly, along the longitudinal axis to the inboard end of that handle component, and has a plastic-like twist locking mechanism fixed in place at the inboard end. The twist locking mechanism comprises a hard plastic-like material shaft between about 2 and 4 inches long, with a small central aperture through the length, along the long axis, sufficient to allow the passage of air, as well as a split rotatable rings The shaft of the locking mechanism has an outboard diameter sufficiently sized to be press fit a distance of between about 1 and 2 inches into the inboard end of the outboard component of the handle. It has a greatest external diameter sufficient to match the outside diameter of the outboard handle commencing between about 1 and 2 inches from the most outboard end of the shaft. The locking mechanism shaft is reduced to form an off-center shaft with a lobe, between about ¼ inch and 1 inch in diameter, a distance of between about ½ inch and 1 inch along the long axis, to accept the split rotatable ring. The lobed portion is located between about ¼ and ½ inch from the inboard end of the shaft. The rotatable split ring, comprised of plastic, the width of between about ½ inch and 2 inches, has its inside diameter sufficient to accommodate the lobed shaft of the locking mechanism shaft. The lobe is off-center and the locking ring is of varied thickness. The inboard component of the handle comprises a straight tube-like shaft of light-weight material, of between about 1 and 2 inches in diameter, having a wall thickness sufficient to provide rigidity. The inboard component has an overall internal diameter sufficient to accommodate the outside diameter of the outboard component. Both the inboard and outboard ends of the inboard component are open, which allows a hanging cap to be press fit into the open end of the inboard end of the inboard component. The hanging cap comprises a shaft, between about 3 and 4 inches in length, made of a hard plastic. In position between the shovel and the handle is a movable holder that has an inboard component and an outboard component. The outboard component comprises a shaft of plastic with a diameter of between about ½ inch and 1–½ inches, which terminates at its outboard end in a flat, circular, surface which lies on the lateral axis. The flat surface has an aperture of between about 1 and 2 inches in depth and a diameter of between about ½ inch to 1 inch. The aperture is located centrally in the flat surface of the outboard end, on the longitudinal axis. It is configured to allow for a press fit of the connecting member of the shovel into the outboard end of the outboard component of the movable holder. The overall length of the outboard component is between about 4 and 6 inches. The inboard end of the outboard component of the movable holder has a diameter of between about ¾ inch and 1–½ inches. The diameter of the outboard end of the outboard component is between about 1 and 2 inches in diameter, with the diameter of the inboard end of the outboard component being larger than the outboard diameter of that component. The inboard end of the outboard component is rounded at the end, having a radius of between about ½inch and 1 inch, and two parallel surfaces that lie in the longitudinal axis. The parallel surfaces that lie in the mid line of the shovel, have a thickness of between about ½ inch and 1 inch. One parallel surface is flat and the other parallel surface has raised ridged teeth runs from the central point of the surface, radially to the outer edge of the inboard end. There is an aperture, sized to accommodate a locking bolt, centrally located, perpendicular to the parallel surfaces of that end and lying in the lateral axis on the inboard end of the outboard component. The inboard component of the movable holder, has an inboard and outboard end. The inboard end comprises a shaft of plastic material, of between about 5 and 7 inches in length, with an outside diameter of between about 1 and 2 inches. The inboard end of the inboard component of the movable holder has an aperture running from the inboard end of the inboard component of the movable holder, inward, centrally, along the longitudinal axis between about 2 and 3 inches. This aperture has an inside diameter being sufficiently sized, and the inboard side of the inboard component of the movable holder wall has a sufficient wall thickness, to accommodate a shaft, being the handle thread, which could be treated attached to the inboard end of the inboard component. The threaded aperture runs to within between about 1 and 3 inches of the most outboard end of the inboard component of the movable holder. The outboard end of the inboard component is rounded, and has a radius of between about ½ inch and 1 inch. The outboard end of the rounded end of the inboard component has two parallel surfaces, defining a thickness of between about ¼ inch and 1 inch in thickness, lying in the longitudinal axis and parallel with the mid line of the shovel. These parallel surfaces each having raised ridged teeth which run from the central point of the surface, radially to the outer edge of the outboard end. There is an aperture, sized to accommodate a locking bolt, centrally located, perpendicular to the parallel surfaces of the outboard end of the inboard component of the movable holder, lying in the lateral axis. Through this aperture a locking bolt with a wingnut are employed. The bolt is threaded with between about a three sixteenths and one half inch thread. The bolt functions to hold together the ridged, toothed surfaces of the inboard and outboard components of the movable holder, locking the parts in place, but allowing a pivoting movement within the long axis by loosening the bolt.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved a gutter cleaning system which has all of the advantages of the prior art house maintenance devices and apparatuses of known design and configuration and none of the disadvantages.

It is another object of the present invention to provide a new and improved a gutter cleaning system which may be easily and efficiently manufactured and marketed.

It is further object of the present invention to provide a new and improved a gutter cleaning system which is of durable and reliable constructions.

An even further object of the present invention is to provide a new and improved a gutter cleaning system which is susceptible of a low cost of manufacture with regard to both materials and labor, and which accordingly is then susceptible of low prices of sale to the consuming public, thereby making such a gutter cleaning system economically available to the buying public.

Even still another object of the present invention is to provide a gutter cleaning system for conveniently removing debris from gutters.

Lastly, it is an object of the present invention to provide a new and improved gutter cleaning system, comprising, a shovel working surface with a connecting component comprising a rigid member having a "Z" shaped configuration, and a handle having an inboard and outboard component with a locking mechanism comprising a shaft and a split rotatable ring, and a hanging cap end, and lastly, a movable holder, having an inboard component coupled to the handle and an outboard component coupled to the shovel, with a locking bolt with a wingnut.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an overview of the entire gutter cleaning system, demonstrating the alignment of the handle, shovel, and movable handle located between.

The same reference numerals refer to the same parts throughout the various Figures employed herein.

DESCRIPTION OF THE PREFERRED EMBODIMENT

Figure 1:
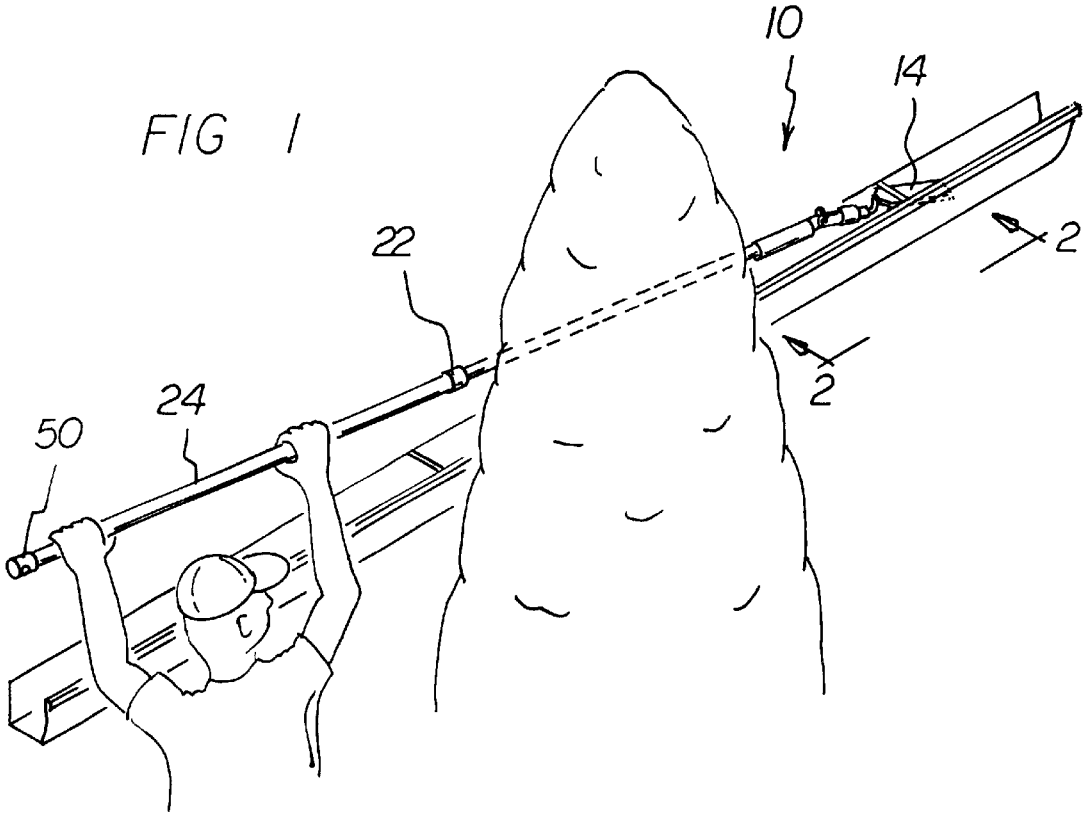
FIG. 1 is a drawing depicting the utilization of the device.
Figure 2:
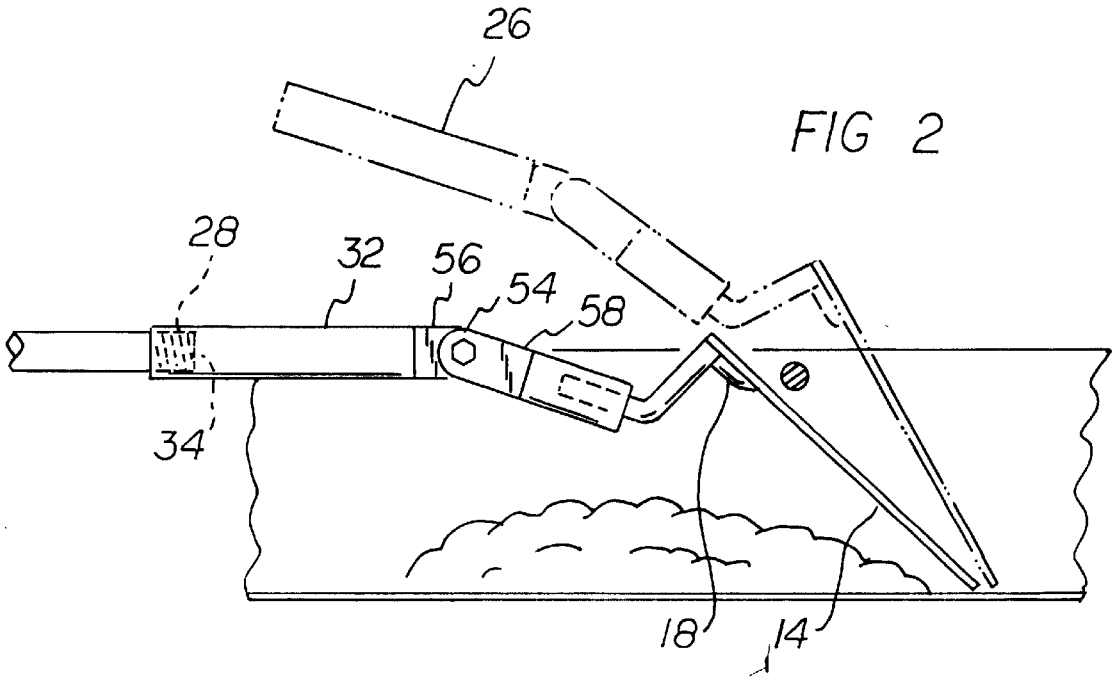
FIG. 2 is a view taken along line 2—2 of FIG. 1, showing the employment of the shovel to move debris in the gutter.
Figure 3:
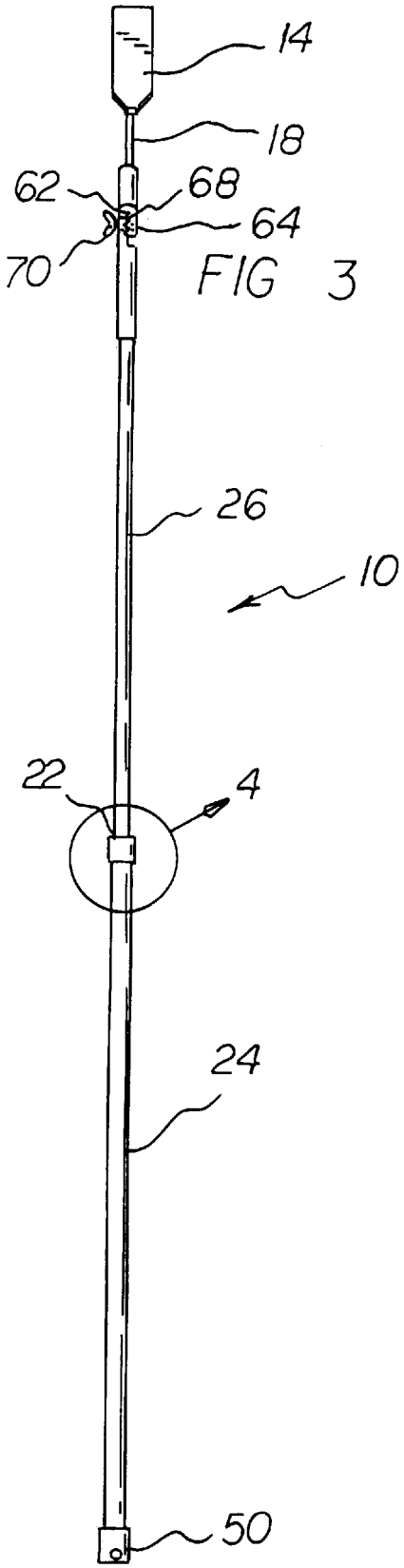
Figure 4:
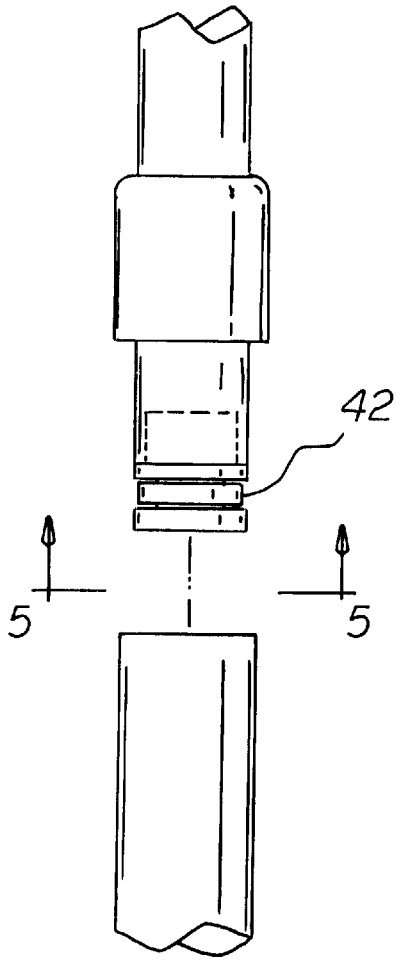
FIG. 4 is an exploded view of the locking mechanism taken at Circle 4 of FIG. 3 which shows the shaft and locking ring of the mechanism as it is employed on the inboard end of the outboard handle.
Figure 5:
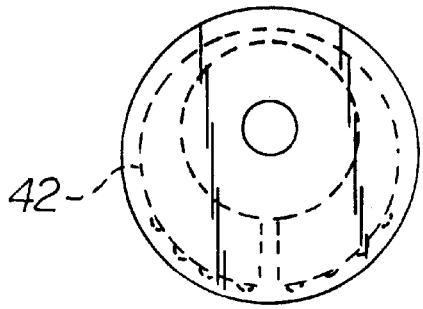
FIG. 5 illustrates the locking mechanism, take from a view along line 5—5 of FIG. 4 which demonstrates the position of the locking ring in relation to the shaft before the lock is engaged.
Figure 6:
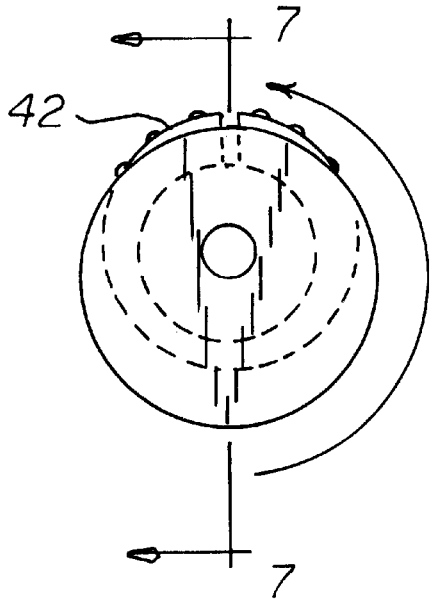
FIG. 6 illustrates the locking mechanism, after it is engaged by rotation of the handles, causing the rotatable ring to move in position, locking the shaft and handle from further rotation.
Figure 7:
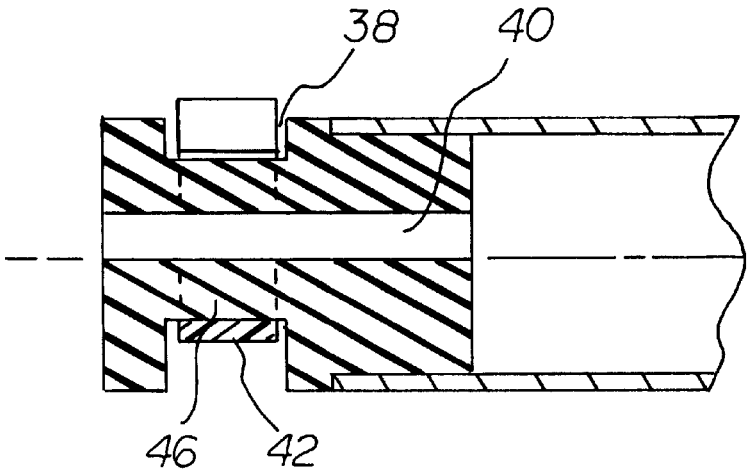
FIG. 7 is a view, taken along line 7—7 of FIG. 6, demonstrating the locking ring which rotates on the shaft to lock, and the air passage aperture.

With reference now to the drawings, and in particular to FIG. 1 thereof, the preferred embodiment of the new and improved a gutter cleaning system embodying the principles and concepts of the present invention and generally designated by the reference numeral 10 will be described.

The present invention, the a gutter cleaning system 10 is comprised of a plurality of components. Such components in their broadest context include a shovel, a handle, and a movable holder. Such components are individually configured and correlated with respect to each other so as to attain the desired objectives. The gutter cleaning system 10 functions for safely and conveniently removing debris from gutters. It comprising the following components, in combination.

The first component is a shovel 14 that is in a flat, rectangular configuration is comprised of a rigid material, preferably metal, although a rigid plastic or other suitable rigid material could be utilized. The shovel has a thickness of between about 10/1000ths to 30/1000ths of an inch, giving it strength and rigidity to sufficiently provide a rigid, durable working surface. The shovel size is between about 5 and 6 inches in length on the longitudinal axis and between about 2 and 3 inches in width on the transverse axis, also known as the lateral axis. The shovel has a ratio of length to width being between about 2.0 to 2.5. The shovel ends with a square edge on the outboard end and in a V-like shape, pointed in the long axis, at the inboard end.

There is a connecting component 18 comprising a rigid, preferably metal shaft having the diameter of between about ¼ to ¾ inch, in a "Z" shaped configuration. As in the case of the shovel, a rigid plastic may also be used as well in the making of this component. The two ends of the "Z" have between about 10 and 30 degrees of angle off the longitudinal axis of the shovel. The central portion is continuous with the two ends. The outboard end is attached and blended into the shovel surface, preferably by a weld to the midpoint of the inboard end of the shovel. The weld is located at the midpoint of the inboard end of the shovel. The inboard end of the connecting component is in the form of a rounded shaft.

The second component of the invention is the handle 22 which has an inboard component 24 and an outboard component 26. The outboard component comprises a straight, tube-like shaft of lightweight material, either metal, such as aluminum, or a composite, such as fiberglass, the latter acting to insulate the user from unexpected electric current. The outside diameter is between about ½ inch and 1–½ inches in diameter, having a wall thickness sufficient to provide rigidity. The outboard component has an open outboard end 28, the opening being sized to tightly accommodate the inboard shaft of the handle thread, which is pressed into the outboard end.

The handle thread comprises a shaft 32 of plastic, between about 2 and 4 inches long, having an inboard end and an outboard end. The inboard end is defined as that part of the handle thread 34, from the mid-length point of the handle thread, to the inboard end, having a diameter of between about ¾ inch and 1–½ inches. The handle thread lies in the longitudinal plane with a flat inboard end. The outboard portion of the handle thread runs from the mid-length point of the handle thread shaft, along the longitudinal axis to the outboard end of the handle thread. The outboard portion is threaded to mate with the threads of the inboard end of the handle connector.

The outboard component 26 runs inboardly, along the longitudinal axis to the inboard end of that handle component, and has a plastic-like twist locking mechanism 38 fixed in place at the inboard end. The twist locking mechanism comprises a hard plastic-like material shaft between about 2 and 4 inches long. It has a small central aperture 40 through the length of the shaft, along the long axis, sufficient to allow the passage of air. The locking mechanism utilizes a split rotatable ring 42. The shaft of the locking mechanism has an outboard diameter sufficiently sized to be press fit a distance of between about one and two inches into the inboard end of the outboard component of the handle. It has a greatest external diameter sufficient to match the outside diameter of the outboard handle commencing between about 1 and 2 inches from the most outboard end of the shaft.

The locking mechanism shaft is reduced in diameter to form an off-center shaft with a lobe 46, between about ¼ inch and 1 inch in diameter, a distance of between about ½ inch and 1 inch along the long axis, to accept the split rotatable ring. The lobed portion is located between about ¼ inch and ½ inch from the inboard end of the shaft. The rotatable split ring, comprised of plastic, or other rigid material has a width of between about ½ inch and 2 inches. It functions as a locking mechanism. The split ring has its inside diameter sufficient to accommodate the lobed shaft of the locking mechanism shaft. The lobe is off-center and the locking ring is of varied thickness.

The inboard component of the handle comprises a straight tube-like shaft of the same lightweight material described above. The shaft has a thickness of between about 1 and 2 inches in diameter, and a wall thickness sufficient to provide rigidity. The inboard component has an overall internal diameter sufficient to accommodate the outside diameter of the outboard component. Both the inboard and outboard ends of the inboard component are open, which allows a hanging cap 50 to be press fit into the open end of the inboard end of the inboard component. The hanging cap comprises a shaft, between about three and four inches in length, made of a hard plastic material.

The third component is the movable holder 54, that has an inboard component 56 and an outboard component 58, and is positioned between the shovel and the handle, and connects the handle and the shovel, allowing all three components to function as a unit. The outboard component comprises a shaft of plastic with a diameter of between about ½ inch and 1–½ inches. The outboard component terminates at its outboard end in a flat, circular, surface which lies on the lateral axis. The flat surface has an aperture of between about 1 and 2 inches in depth and a diameter of between about ½ inch and 1 inch. The aperture is located centrally in the flat surface of the outboard end, on the longitudinal axis. It is configured to allow for a press fit of the connecting member of the shovel into the aperture at the outboard end of the outboard component of the movable holder. The overall length of the outboard component is between about 4 and 6 inches.

The inboard end of the outboard component of the movable holder has a diameter of between about ¾ inch and 1–½ inches. The diameter of the outboard end of the outboard component is between about 1 and 2 inches in diameter, with the diameter of the inboard end of the outboard component being larger than the outboard diameter of that component. The inboard end of the outboard component is rounded at the end, having a radius of between about ½ inch and 1 inch, and two parallel surfaces that lie in the longitudinal axis. The parallel surfaces that lie in the mid line of the shovel, have a thickness of between about one half and one inch. One parallel surface is flat and the other parallel surface has raised ridged teeth 62 running from the central point of the surface, radially to the outer edge of the inboard end. There is an aperture, sized to accommodate a locking bolt 64, centrally located, perpendicular to the parallel surfaces of that end and lying in the lateral axis on the inboard end of the outboard component.

The inboard component of the movable holder, has an inboard and outboard end. The inboard end comprises a shaft of plastic material, of between about 5 and 7 inches in length, with an outside diameter of between about 1 and 2 inches. The inboard end of the inboard component of the movable holder has an aperture running from the inboard end of the inboard component of the movable holder, inward, centrally, along the longitudinal axis between about 2 and 3 inches. This aperture has an inside diameter being sufficiently sized, and the inboard side of the inboard component of the movable holder wall has a sufficient wall thickness, to accommodate a shaft, being the handle thread, which could be threadedly attached to the inboard end of the inboard component. The threaded aperture runs to within between about 1 and 3 inches of the most outboard end of the inboard component of the movable holder.

The outboard end of the inboard component is rounded, and has a radius of between about ½ and 1 inch. The outboard end of the rounded end of the inboard component has two parallel surfaces defining a thickness of between about ¼ inch and 1 inch in thickness, lying in the longitudinal axis and parallel with the mid line of the shovel. These parallel surfaces each having raised ridged teeth which run from the central point of the surface, radially to the outer edge of the outboard end. There is an aperture sized to accommodate a locking bolt centrally located, perpendicular to the parallel surfaces of the outboard end of the inboard component of the movable holder, lying in the lateral axis. Through this aperture a locking bolt with a wingnut 70 are employed. The bolt is threaded with between about a 3/16ths and ½ inch thread. The bolt functions to hold together the ridged, toothed surfaces of the inboard and outboard components of the movable holder, locking the parts in place, but allowing a pivoting movement within the long axis by loosening the bolt.

The pivoting of the shovel allows versatility to the invention, by allowing the operator to place the working edge in almost any angle necessitated by the working situations. For example, the movable handle may be positioned, at the most closed extreme, between about 40 to 45 degrees, with the "Z" angle placing the working surface at between about 20 and 25 degrees from the long axis of the handle. As one can see, this allows for an acutely angled working surface, providing the operator with reach under overhanging objects and obstructions. The movable handle may also be positioned at an extreme open position, between about 40 and 45 degrees off of the long axis of the system, allowing the operator to use the angulation of the shovel to his advantage to reach beneath obstructions, when using this system.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gutter cleaning system for safely and conveniently removing debris from gutters, comprising, in combination;

a shovel in a flat rectangular configuration, having a longitudinal axis along its length and a transverse axis long its width being comprised of a rigid metal, having a thickness of between about 10/1000 ths to 30/1000 ths of an inch, sufficient to provide a rigid working surface, the shovel measuring between about 5 and 6 inches in length on the longitudinal axis and between about 2 to 3 inches in width on the transverse axis, also known as the lateral axis, having a ratio of length to width being between about 2.0 to 2.5 and having an inboard end and an outboard end with the shovel ending with an square edge on the outboard end with the inboard end having a V-shaped configuration being pointed in the direction of the longitudinal axis, a connecting component shaft fabricated of a rigid material having a diameter of between about ¼ to ¾ inch, the connecting component shaft having an inboard end and an outboard end and a central portion there between having a "Z" shaped configuration with the two ends having between about 10 to 30 degrees of angle off the longitudinal axis of the shovel, the central portion being continuous with the two ends, the outboard end attached and blended into the shovel surface, attached by a weld to the midpoint of the inboard end of the shovel, and the inboard end of the connecting component shaft being in the form of a rounded shaft;

a telescoping tubular configured two part handle having an inner handle and an outer handle each having an inboard end component and an outboard end component, each part of the handle comprising a straight tubular shaft of lightweight rigid material, between about ½ inch to 1–½ inches in diameter being slidably coupled and having a wall thickness sufficient to provide rigidity, the outboard end component of the inner handle having a male thread, the outboard end component of the outer telescoping handle having a plastic twist locking mechanism fixed in place at the inboard end component of the inner handle, the twist locking mechanism comprising a rigid material shaft between about 2 and 4 inches long, with a central aperture through the length of the shaft sufficient to allow the passage of air, the mechanism also having a split rotatable ring, the mechanism shaft having a first outboard external diameter sufficiently sized to be press fit a distance of between about 1 and 2 inches into the inboard end of the inner handle, and the shaft having a second larger inboard external diameter sufficient to match the outside diameter of the outboard end of the outer handle commencing between about 1 and 2 inches from the most outboard end of the shaft, with said mechanism shaft reduced to form an off-center shaft with a lobe, between about ¼ inch and 1 inch in diameter, the lobe having a length of between about one half and one inch and able to accept the split rotatable ring being located between about ¼ inch and ½ inch from the inboard end of the shaft, and the rotatable split ring, fabricated of plastic having a width of between about ½ inch and 2 inches and having an inside diameter sufficient to accommodate the lobed shaft of the locking mechanism shaft, said lobe being off-center and the ring having a varied thickness, and the outer handle having an overall internal diameter sufficient to accommodate the outside diameter of the inner handle, the outer handle having an outboard end which is open, and an inboard end, which is open, allowing a hanging cap, press fit into the open end of the inboard end of the outer handle, comprising a shaft, between about 3 and 4 inches in length, made of a hard plastic material; and, a movable holder, having an inboard component and an outboard component, the outboard component comprising a shaft of plastic with a diameter of between about ½ inch and 1–½ inches, which terminates at its outboard end in a flat, circular surface having an aperture of between about 1 and 2 inches in depth and a diameter between about ½ inch to 1 inch, which lies centrally in the flat end surface of the outboard end which is configured to allow for a press fit of the in board end of the connecting component shaft of the shovel into the outboard end of the outboard component of the movable holder, the overall length of the outboard component being between about four and six inches, with an inboard end of the outboard component of the movable holder having a diameter between about three quarters and one and one half inches and the diameter of the outboard end of the outboard component which is between about one and two inches in diameter, with the inboard end of the outboard component being rounded at the end, having a radius of between about one half inch and one inch, and having two parallel surfaces with a thickness of between about one half and one inch, one parallel surface being flat and the other parallel surface having raised ridged teeth running from the central point of the surface, radially to the outer edge of the inboard end, with an aperture centrally located and the inboard component of the movable holder having an inboard and outboard end with the inboard end comprising a shaft of plastic material, between about five and seven inches in length, with an outside diameter of between about one and two inches, the inboard end of the inboard component of the movable holder having a threaded aperture running from the inboard end of the inboard component of the movable holder, outwardly, between about two and three inches, the threaded aperture having an inside diameter being sufficiently sized to accommodate the male thread of the outboard end component of the inner handle, the threaded aperture runs to within between about one and three inches of the most outboard end of the inboard component of the movable holder, the outboard end of the inboard component being rounded, having a radius of between about one half and one inch, the rounded end of the inboard component having two parallel surfaces, defining a thickness between about one quarter and one inch in thickness and parallel with the mid line of the shovel, the parallel surfaces each having raised ridged teeth which run from the central point of the surface, radially to the outer edge of the outboard end, with a centrally located aperture centrally located and a locking bolt with a wingnut, the bolt coupling and holding together the ridged, toothed surfaces of the inboard and outboard components of the movable holder, allowing a pivoting movement by loosening the bolt.

2. A gutter cleaning system, comprising;

a shovel in a flat rectangular configuration, having a longitudinal axis along its length and a transverse axis long its width being comprised of a rigid metal, sufficient to provide a rigid working surface and a having an inboard end and outboard end with the shovel ending with an square edge on the outboard end with the inboard end having a V-shaped configuration being pointed in the direction of the longitudinal axis, a connecting component shaft fabricated of a rigid material, the connecting component shaft having an inboard end and an outboard end and a central portion there between having a "Z" shaped configuration, the central portion of the shaft being continuous with the two ends, the outboard end attached and blended into the shovel surface, attached by a weld to the midpoint of the inboard end of the shovel, and the inboard end of the connecting component shaft being in the form of a rounded shaft;

a telescoping tubular handle configured two part handle having an inner handle and an outer handle each having an inboard end component and an outboard end component, each part of the handle comprising a straight tubular shaft of lightweight rigid material being slidably coupled, the outboard end component of the inner handle having a male thread, the outboard end component of the outer telescoping handle having a plastic twist locking mechanism to vary the length of the handle the mechanism being fixed in place at the inboard end component of the inner handle, the twist locking mechanism comprising a rigid material shaft with a central aperture through the length of the shaft sufficient to allow the passage of air, the mechanism also having a split rotatable ring, the mechanism shaft having a first outboard external diameter and the shaft having a second larger inboard external diameter with said mechanism shaft reduced to form an off-center shaft with a lobe to accept a split rotatable ring fabricated of plastic having an inside diameter with the lobe being off-center and the ring having a varied thickness, the outer handle having an outboard end which is open, and an inboard end, which is open, allowing a hanging cap, press fit into the open end of the inboard end of the outer handle;

an adjustable holder having an inboard component and an outboard component with the inboard component being coupled to the handle and an outboard component coupled to the shovel, the outboard component comprising a shaft of plastic which terminates at its outboard end in a flat, circular surface having an aperture, with the inboard end of the outboard component being rounded at the end and having raised ridged teeth running from the central point of the surface, radially to the outer edge of the inboard end, with an aperture centrally located and the inboard component of the movable holder having an inboard and outboard end with the inboard end comprising a shaft of plastic material, the inboard end of the inboard component of the movable holder having a threaded aperture running from the inboard end of the inboard component of the movable holder, outwardly, the threaded aperture having an inside diameter being sufficiently sized to accommodate the male thread of the component outboard end of the inner handle, the outboard end of the inboard component being rounded, the rounded end of the inboard component having two parallel surfaces, defining a thickness between with the parallel surfaces each having raised ridged teeth which run from the central point of the surface, radially to the outer edge of the outboard end, with a centrally located aperture centrally located and a locking bolt with a wingnut to vary the angle between the shovel and the handle, the bolt coupling and holding together the ridged, toothed surfaces of the inboard and outboard components of the movable holder, allowing a pivoting movement by loosening the bolt.

* * * * *